US005570561A

United States Patent [19]

May et al.

[11] Patent Number: 5,570,561

[45] Date of Patent: Nov. 5, 1996

[54] APPARATUS FOR PACKAGING FOWL AND OTHER PRODUCTS

[75] Inventors: Dennis J. May, Pittsboro, N.C.; Eddie M. Norton, Jonesboro, Ga.; Samuel H. Arnold, Raleigh, N.C.; Bryan E. Wilkins, Raleigh, N.C.; Brian K. Digeso, Raleigh, N.C.; Kuo-Raid G. Chen, Cary, N.C.

[73] Assignee: Delaware Capital Formation, Inc., Wilmington, Del.

[21] Appl. No.: 481,182

[22] Filed: Jun. 7, 1995

Related U.S. Application Data

[63] Continuation of Ser. No. 183,484, Jan. 18, 1994.

[51] Int. Cl.[6] ..... B65B 61/00; B65B 43/14; B65B 1/00; B65B 3/00

[52] U.S. Cl. ..... 53/138.4; 53/284.7; 53/571; 53/258

[58] Field of Search ..... 53/258, 571, 572

[56] References Cited

U.S. PATENT DOCUMENTS

| | | | |
|---|---|---|---|
| 2,880,419 | 4/1959 | Tipper | 1/3 |
| 2,946,166 | 7/1960 | Baxter | 53/258 |
| 3,145,517 | 8/1964 | Saumsiegle | 53/258 |
| 3,238,698 | 3/1966 | Hollenton | 53/258 |
| 3,394,528 | 7/1968 | Tipper | 53/112 |
| 3,543,378 | 12/1970 | Klenz | 29/243.57 |
| 3,717,972 | 2/1973 | Niedecker | 53/138.4 |
| 3,942,302 | 3/1976 | Bloom | 53/138 |
| 3,971,191 | 7/1976 | Hoyland | 53/258 |
| 4,001,926 | 1/1977 | Verlarde | 29/243.56 |
| 4,004,339 | 1/1977 | Verlarde | 29/243.56 |
| 4,059,868 | 11/1977 | Meyn | 17/11 |
| 4,062,169 | 12/1977 | Lister et al. | 53/258 |
| 4,147,012 | 4/1979 | van Mil | 53/572 |
| 4,183,194 | 1/1980 | Lucke | 53/571 |
| 4,219,989 | 9/1980 | Andrews | 53/572 |
| 4,352,263 | 10/1982 | Andrews, Jr. | 53/436 |
| 4,388,811 | 6/1983 | Zebarth | 62/63 |
| 4,406,037 | 9/1983 | Hazenbroek | 17/11 |
| 4,432,188 | 2/1984 | Andrews | 53/572 |
| 4,457,124 | 7/1984 | Hartmann | 53/572 |
| 4,468,838 | 9/1984 | Sjostrom et al. | 17/11 |
| 4,610,050 | 9/1986 | Tieleman et al. | 17/11 |
| 4,616,380 | 10/1986 | Tieleman | 17/11 |
| 4,683,616 | 8/1987 | Tieleman | 17/11 |
| 4,731,807 | 3/1988 | Tieleman | 17/11 |
| 4,731,907 | 3/1988 | Tieleman | 17/11 |
| 4,776,063 | 10/1988 | Tieleman | 17/45 |
| 4,935,990 | 6/1990 | Linnenbank | 17/11 |
| 4,951,353 | 8/1990 | Tieleman | 17/11 |
| 4,958,408 | 9/1990 | Meyn | 17/11 |
| 4,965,908 | 10/1990 | Meyn | 17/11 |
| 4,971,845 | 11/1990 | Aaker et al. | 428/34.9 |
| 5,080,630 | 1/1992 | Tieleman et al. | 452/165 |
| 5,088,959 | 2/1992 | Heemskerk | 452/183 |
| 5,092,815 | 3/1992 | Polkinghorne | 452/179 |
| 5,098,333 | 3/1992 | Cobb | 452/106 |
| 5,147,241 | 9/1992 | Rudin | 452/169 |
| 5,194,035 | 3/1993 | Dillard | 452/165 |

FOREIGN PATENT DOCUMENTS

| | | | |
|---|---|---|---|
| 0065802 | 12/1982 | European Pat. Off. | B65B 25/06 |
| 2909506 | 9/1980 | Germany | B65B 25/06 |

OTHER PUBLICATIONS

Starflex® Corporation "PL–500–7 Whole Bird Stretch Bag Packaging System" Product Information Sheet (Undated).

Poly–Clip ECD Product Information Sheet (Undated).

Technopack® Poultry Packaging Automat, Model GVA Product Information Sheet (Undated).

Meyn "automatic bird packing machine" Product Information Brochure (Undated).

Poly–Clip "Clipautomat PCA" Product Information Brochure (Undated).

*Primary Examiner*—John Sipos
*Assistant Examiner*—Rodney Butler
*Attorney, Agent, or Firm*—Banner & Allegretti, Ltd.

[57] ABSTRACT

An apparatus for packing fowl which includes first and second work stations. The first work station is provided to receive the product to be packaged. A pusher mechanism pushes the product from the first station between spaced plates into a plastic bag and then through the gates of a clipper mechanism. Advancement is slightly retarded by means of a blocking mechanism to thereby insure that the product is tightly retained within the flexible plastic bag. The bag and product are thereby moved to the second station at which time a holding bar preliminary closes the bag. Thence, gates close and gather the neck of the bag and a metal clip is advanced by means of a punch in a clip channel defined by the closed gates. The clip is thereby fastened about the neck of the closed plastic bag and the excess tail of the bag is cut by means of a knife. Trap doors then release the packaged product onto a conveyor belt, a new bag is positioned on the spaced, guide plates, and the apparatus is ready to recycle.

6 Claims, 8 Drawing Sheets

APPARATUS FOR PACKAGING FOWL AND OTHER PRODUCTS

This application is a continuation of application Ser. No. 08/183,484, filed Jan. 18, 1994.

BACKGROUND OF THE INVENTION

This invention relates to an improved packaging device and, more particularly, to a device for the packaging of fowl, such as chickens, in plastic bags with a U-Shaped metal clip for closure of the bag.

The use of U-Shaped metal clips for closure of packaging has been taught in various prior art patents including the following: U.S. Pat. Nos. 3,394,528, 3,543,378, 2,880,419, 4,004,339, and 4,001,926. These various prior art patents disclose placement of a product in casing material. The casing is then closed or sealed by means of a U-Shaped metal clip formed about the gathered casing.

Packaging of fowl, such as chickens, in a flexible bag has heretofore been highly labor intensive and has required numerous steps. For example, placement of a chicken in a plastic bag followed by sealing of the bag has required a series of work stations with a single operation performed at each station and wherein manipulation and reorientation of the product and bag have been required. The present invention relates to a device which provides for packaging of products, such as chickens, in a simplified manner involving only two principal work stations.

SUMMARY OF THE INVENTION

In a principal aspect, the present invention comprises an apparatus for packaging of a product, such as fowl, which apparatus includes a frame having first and second principal work stations.

The first work station includes a horizontal support surface defined between spaced, product retention plates. The plates are capable of moving toward and away from one another and, together, define a product pathway with an entry end and an exit end at the first station. A pusher mechanism is arranged adjacent the entry end for pushing a product into a bag at the first station and then to a second station aligned with the first station. Thus, a flexible plastic bag is fitted over the spaced plates at the exit end of the pathway so that the product pushed by the pusher mechanism will be driven into the flexible plastic bag.

The second work station is defined by a horizontal platform generally on the same plane as or slightly below the horizontal support of the first work station. The second work station platform comprises a trap door mechanism and further includes a block which may advance and retract into the region of the second station to thereby retard and control the movement of the product and flexible bag from the first work station to the second work station.

Intermediate the first work station and the second work station is a clipping apparatus for gathering, closing and sealing the open end of the flexible bag that has been moved to the second work station. That is, the open end of the bag projects into the region of the clipping apparatus from the second work station. Thus, the flexible bag, once positioned at the second work station, will be partially closed by a piston actuated holding bar. Gathering gates on opposite sides of the neck of the flexible bag are then closed about the flexible bag to thereby gather the bag and to also define a clip channel. Subsequently, a U-Shaped metal clip is driven in the clip channel by means of a piston actuated punch. The U-Shaped metal clip is formed about the neck of the gathered flexible bag to thereby close and seal the bag. The excess tail or outer end of the flexible bag is then cut or clipped by a piston actuated knife mounted on one of the gate members. Subsequent to attachment of the clip to the neck of the flexible bag and cutting of the excess tail amount therefrom, the gates are opened, the block travels to a fully retracted position, and the trap door mechanism at the second work station is actuated to drop the product onto a conveyor.

Substantially simultaneous therewith, the plates arranged at the first work station are actuated to receive and retain a new flexible bag. Thus, a bag mounted on a storage platform adjacent the first station is opened by compressed air and is fitted over the ends of the plates. The plates are then separated to retain the bag thereon, thereby permitting recycling of the apparatus.

Thus, it is an object of the invention to provide an improved packaging apparatus.

It is a further object of the invention to provide an improved packaging apparatus especially useful in the packaging of fowl or other similar products wherein the apparatus is comprised of first and second principal work stations.

Another object of the invention is to provide a packaging apparatus useful for the packaging of product in a flexible plastic bag wherein the bag is retained at a first work station by means of generally parallel plates spaced from one another so that the product may be pushed between the plates into the bag.

Yet another object of the invention is to provide an improved packaging apparatus wherein product is pushed from a first work station into a flexible package to a second work station and further wherein the open end of the bag projects from the second work station toward the first work station into the pathway of the clipping apparatus which is designed to close and seal the bag.

Yet a further object of the invention is to provide a simplified packaging apparatus having first and second work stations wherein the apparatus operates sequentially to transfer product from a first work station to a second station in a manner which positions the product within a flexible bag during the transfer and further positions the product at the second station in a manner which permits closing and sealing of the bag.

Yet another object of the invention is to provide an improved packaging apparatus which permits the packaging of fowl, such as chickens, in a manner which is commercially acceptable and attractive to consumers.

Yet a further object of the invention is to provide an improved packaging apparatus which is easy to operate and which operates at a high rate of speed to effect packaging.

These and other objects, advantages and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENT

General Description

Figure 1:
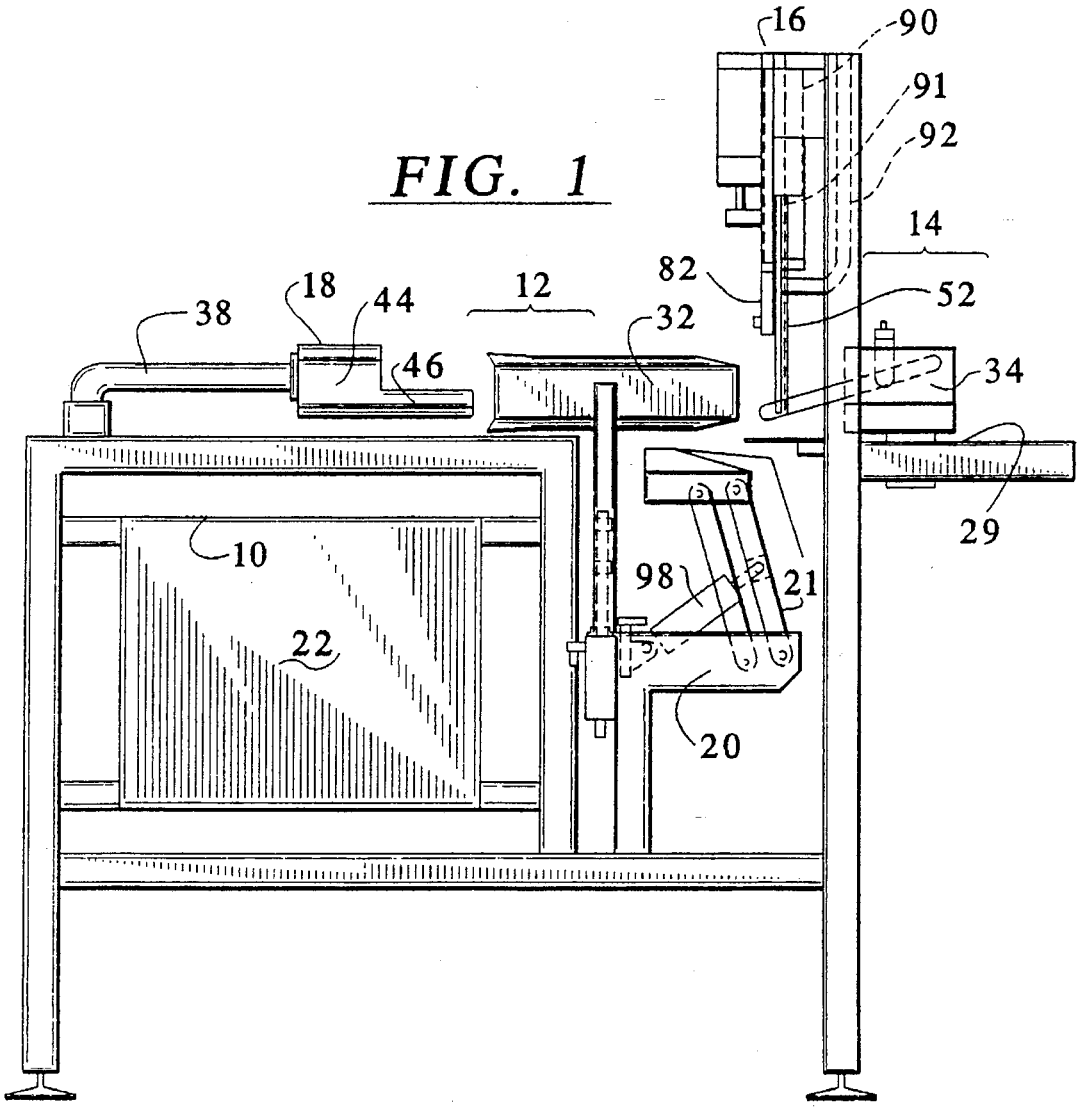
FIG. 1 is a side elevation of the improved apparatus of the invention.
Figure 2:
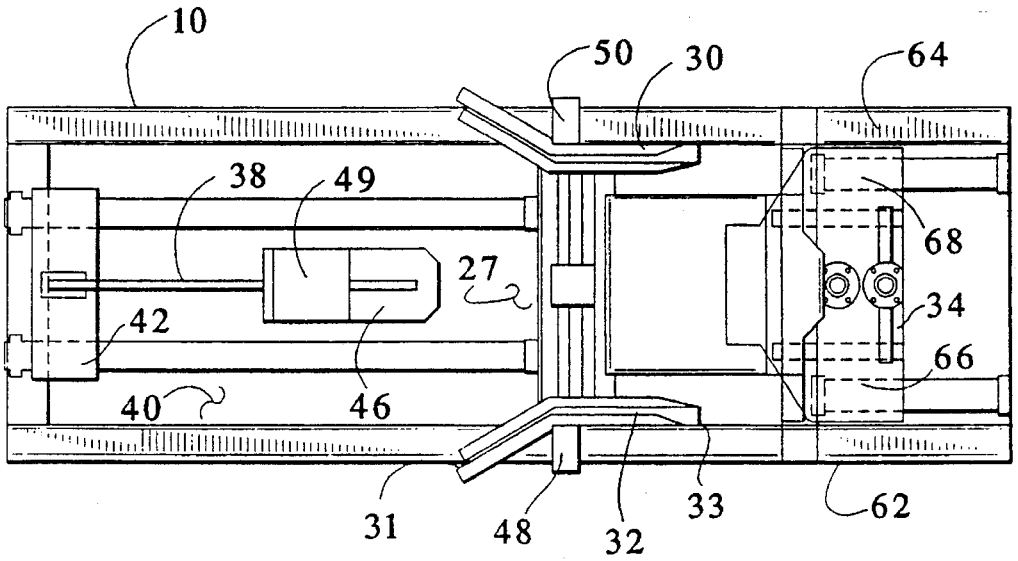
FIG. 2 is a top elevation view of the apparatus of FIG. 1.
Figure 3:
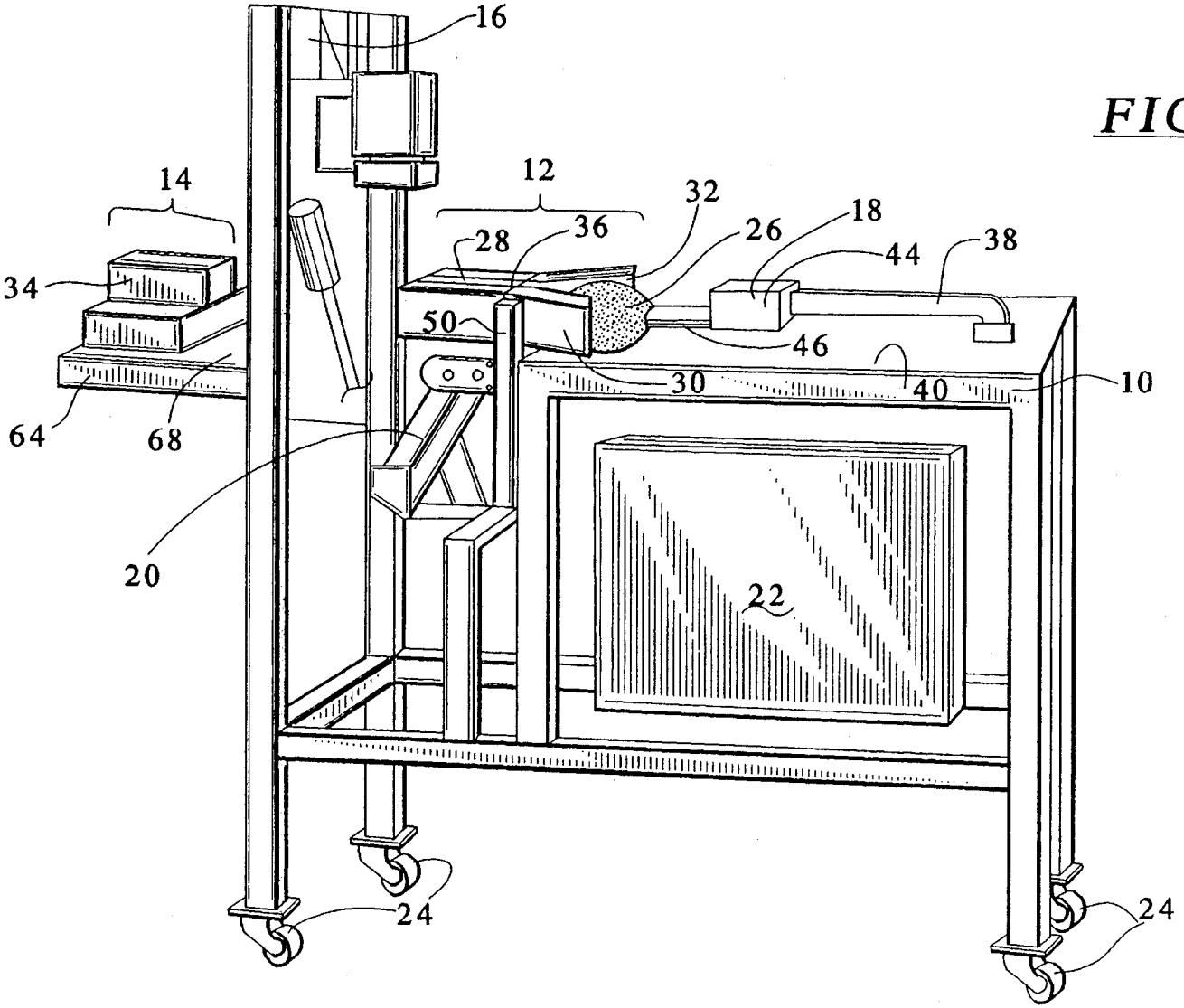
FIG. 3 is an isometric view of the apparatus of the invention.
Figure 4:
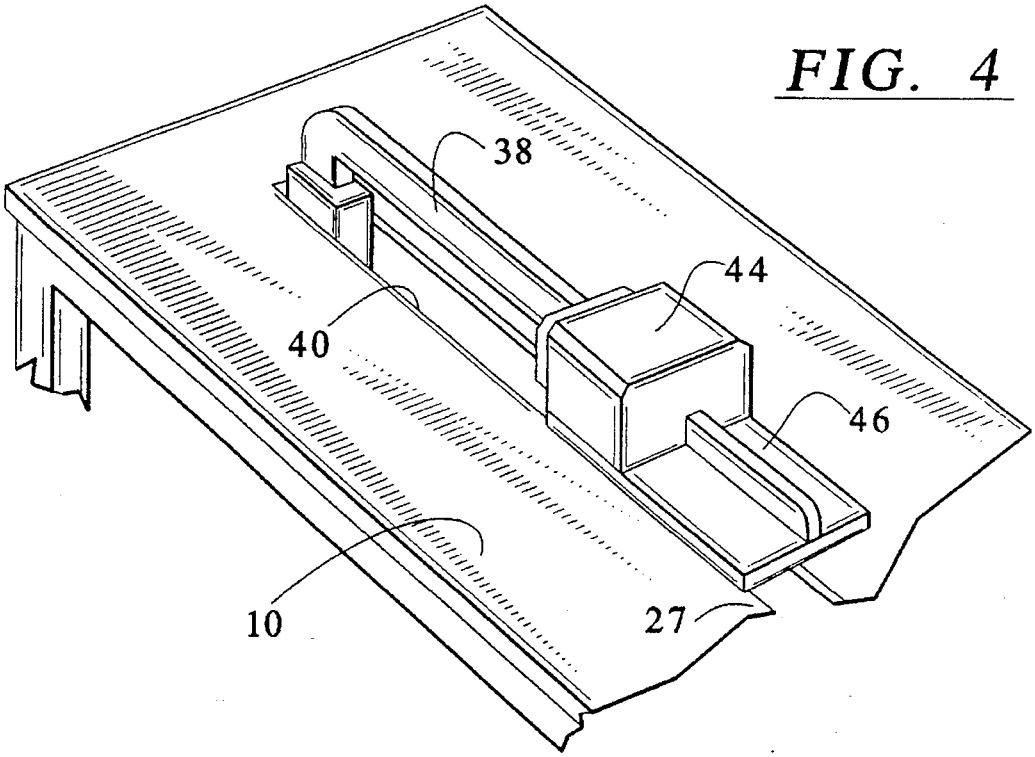
FIG. 4 is an enlarged, isometric view of the pusher, construction.
Figure 5:
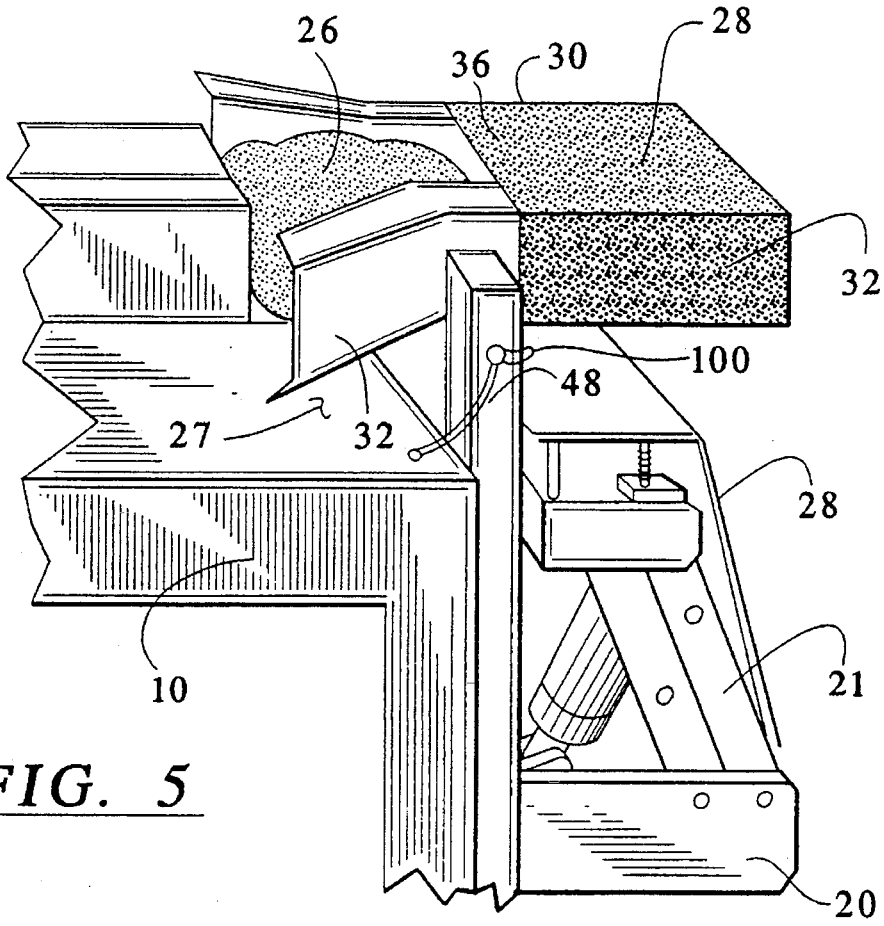
FIG. 5 is an isometric view depicting movement of product into a flexible bag at the first work station.
Figure 6:
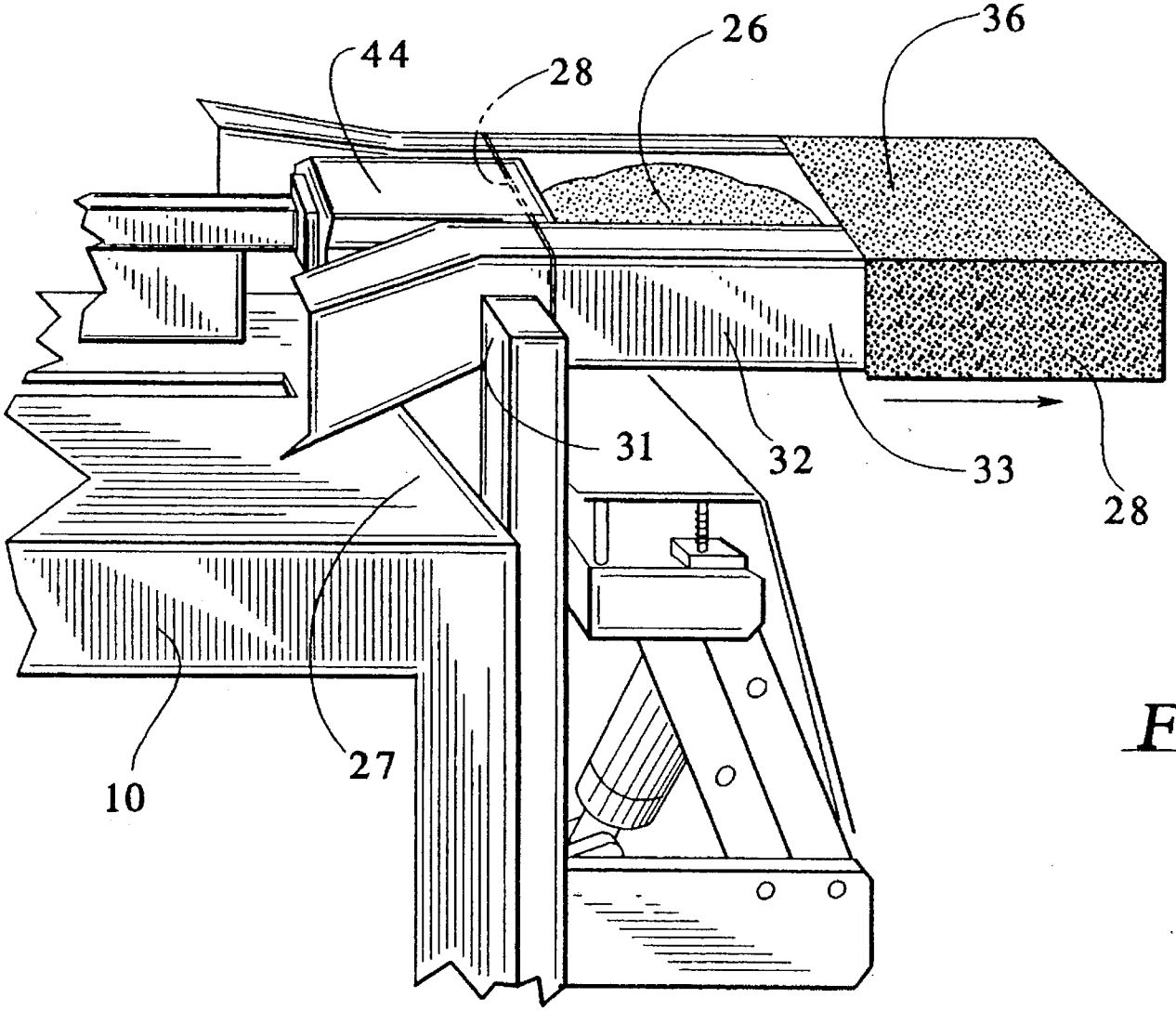
FIG. 6 depicts the movement of the product from the first work station toward the second work station.
Figure 7:
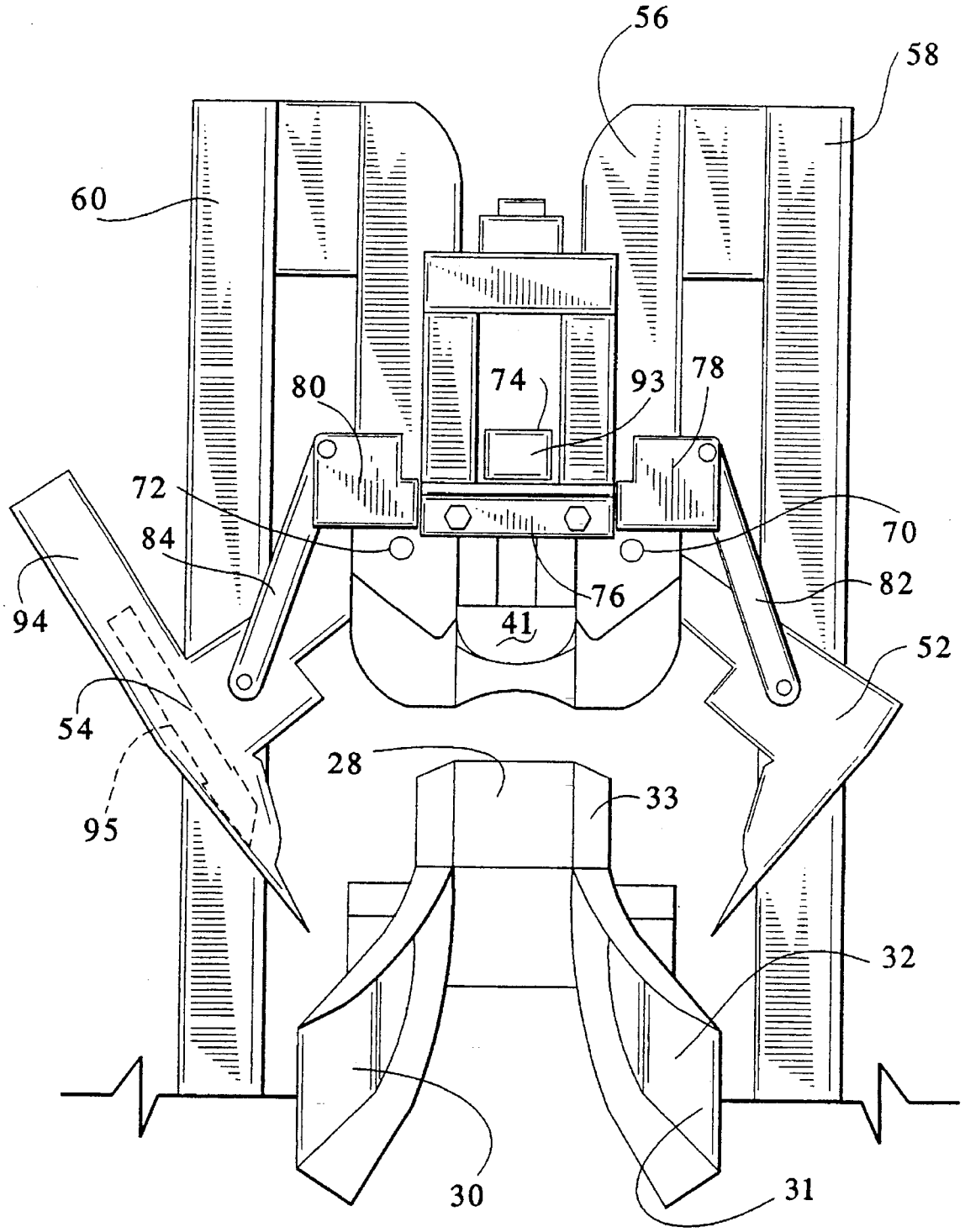
FIG. 7 is a sectional view of the operation at the clipping apparatus.
Figure 8:
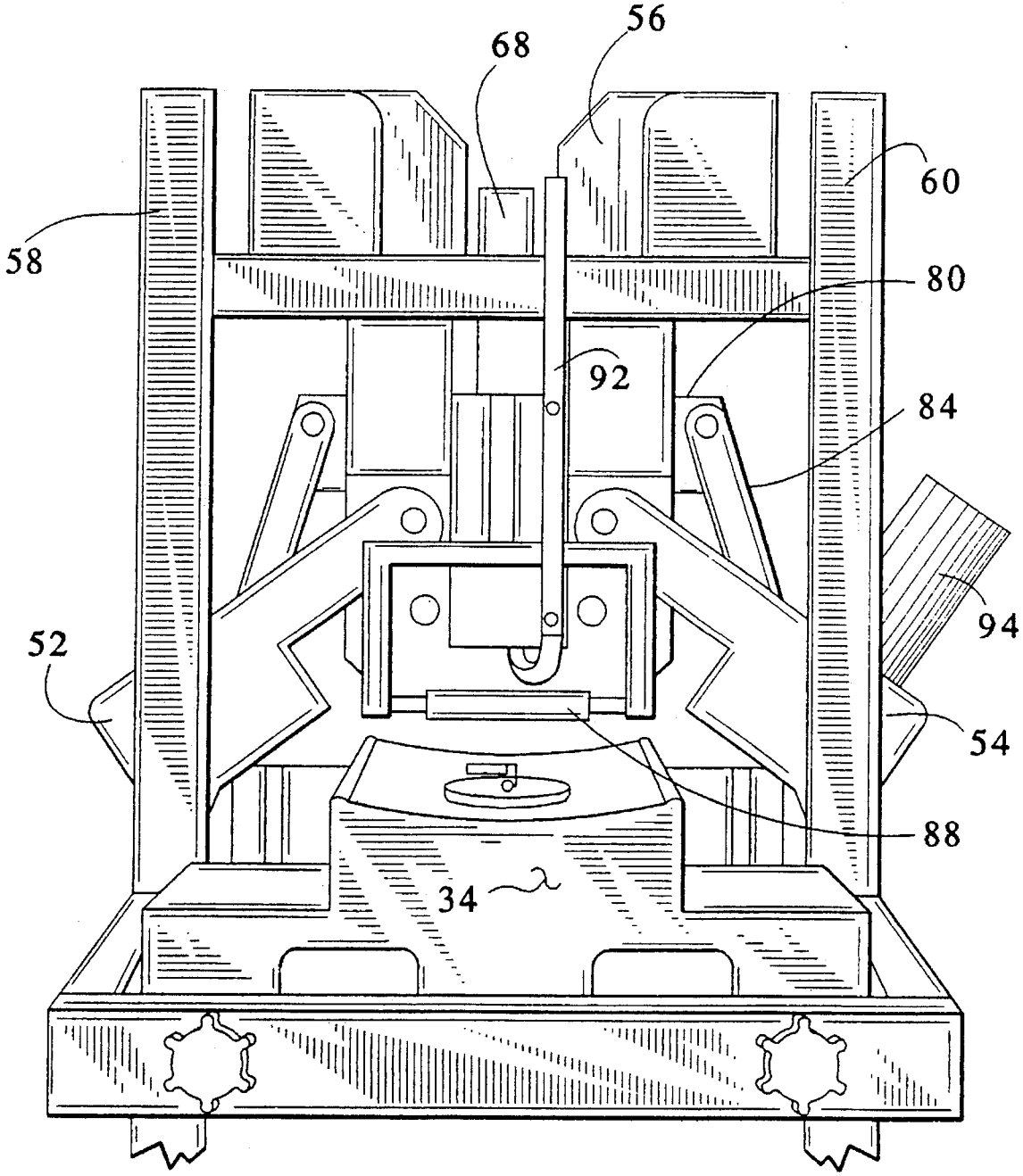
FIG. 8 is a sectional view of the clipping apparatus viewed from the second work station with the gate mechanism in a fully open position.
Figure 9:
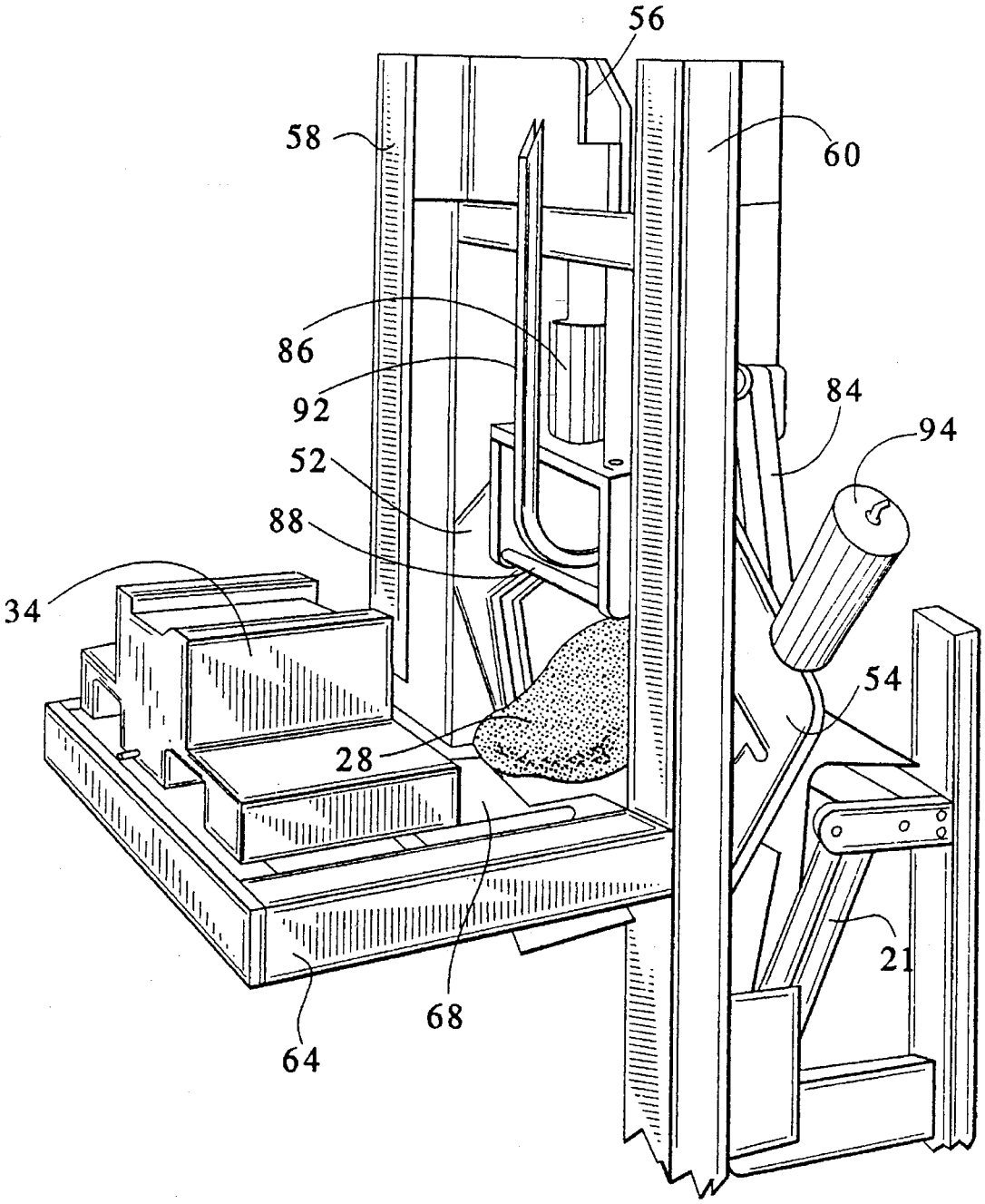
FIG. 9 is an isometric view of the clipper apparatus.
Figure 10:
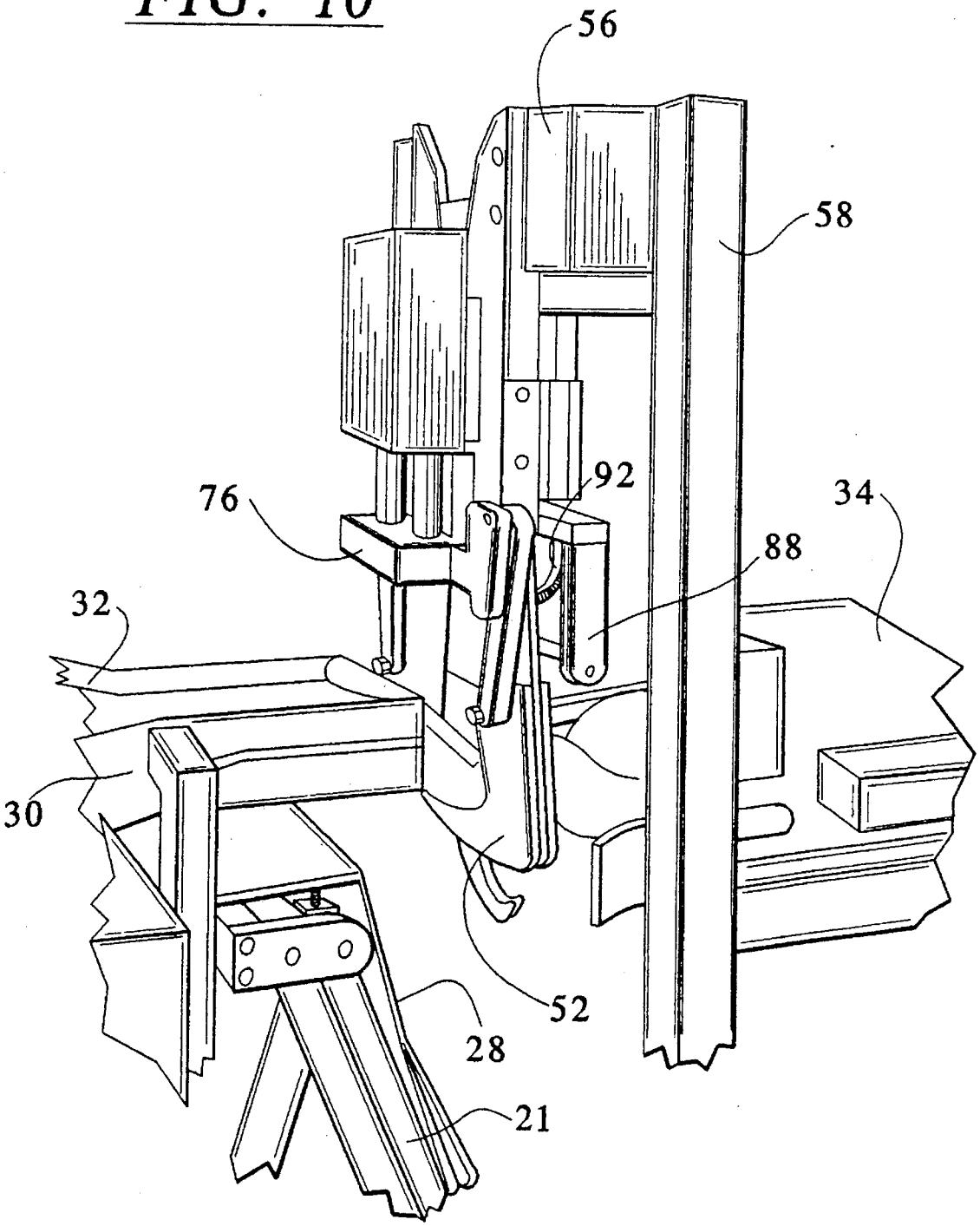
FIG. 10 is an isometric view of the clipping apparatus in the partially closed position.

Referring to the figures, the apparatus of the present invention is supported on a moveable frame 10 and includes a first product placement work station 12 and a second bag closing work station 14 with a clipping apparatus 16 positioned between the stations 12 and 14. A pusher mechanism 18 is provided to transport product 26 from the first station 12 to the second station 14. A bag dispenser 20 is positioned beneath and adjacent to the first station 12 intermediate the first station 12 and the clipping apparatus 16. A control panel 22 is mounted on the frame 10, and the frame 10 is mounted on wheels 24 so that the apparatus is generally totally self contained and mobile.

In operation, product 26, such as fowl, for example, a chicken, is positioned at the first station on a horizontal support surface 27. A flexible bag 28 is retained on spaced plates 30 and 32 with the open end of the bag 28 facing the product 26 positioned on surface 27 to thereby receive the product 26 in response to movement of the pusher mechanism 18. Operation of the pusher mechanism 18 causes the product 26 to move into the bag 28. The combined product 26 and bag 28 are further moved to the second station 14 in between the gathering arms or gates 52, 54 of the clipping apparatus 16. Movement to the second work station 14 is slightly retarded by the reciprocally sliding block 34 which is controlled by an adjustable air flow control brake mechanism and is thereby positioned to engage against the product 26 and bag 28. Consequently, the product 26 is tightly maintained within the bag 28 as the combination of product 26 and bag 28 are moved to the second work station 14.

The second work station 14 also includes a horizontal support platform 29 which is substantially at the same level as the support platform 27 associated with the first station 12. The support platform or surface 29 associated with the second station 14 may, however, be at a slightly lower elevation inasmuch as the product 26 and bag 28 will tend to fall slightly due to gravity during transport by operation of the pusher 18.

Once the bag 28 with the product 26 therein is appropriately positioned at the second station 14, the open end 36 of the bag 28 will project toward the first station and into the region of the clipping apparatus 16. The clipping apparatus 16 will then operate to close and seal the open end of the bag 28 and thereafter cut off the excess amount or tail of the bag 28. Subsequently, block 34 fully retracts from the second work station 14 and the trap doors defining the horizontal support surface 29 of the second work station 14 will open to release the product 26 in the bag 28 vertically downward onto a conveyor. Thereafter, the clipping apparatus 16 will open gates 52, 54 and the bag dispenser 20 will move upwardly and in a manner which permits an air jet to open the open end 36 of a bag 28. The open end 36 is then fitted over the plates 30 and 32 for receipt of further product 26.

Pusher Construction

The pusher 18 comprises an arm 38 which fits through a slot 39 in table 40. The arm 38 coacts with and is driven by a pneumatic cylinder for a reciprocal movement toward and away from the second work station 14. The arm 38 is directly connected to a first, upper block 44. The upper block 44 is slidably attached to a lower block 46. The lower block 46 slides back and forth in the direction toward and away from the second station 14. The blocks 44 and 46 are spring biased relative to each other. That is, a spring (not shown) is positioned intermediate the blocks 44 and 46 so as to bias block 46 forwardly toward the second station 14 relative to block 44. In operation then, as the arm 38 advances and forces the block 44 forward, the lower block 46 will initially engage product 26. Lower block 46 includes indentations for engaging the legs of a chicken, for example, and forcing those legs upwardly in a manner desired for purposes of packaging. As the lower block 46 engages the product 26, resistance of the spring that biases lower block 46 relative to upper block 44 is overcome, and the upper block 44 moves forward over the lower block 46. The block 44 will then move toward becoming aligned with block 46, and jointly the blocks 44, 46 will push the product 26 forward into the bag 28 and toward the second work station 14 between the plates 30, 32 along the pathway therebetween. Then when the product 26 is fully positioned at the second work station 14, the blocks 44, 46 will become aligned, since the block 34 retards further movement.

In operation, product 26 is positioned in front of the lower block 46 in the product pathway between the plates 30 and 32. The first mechanical operation by the apparatus of the invention is the forward movement of the arm 38 to engage the blocks 44, 46 with product 26, to transport product 26 into bag 28, and to thence transport the bagged product linearly along the direction of the pathway from the first work station 12 to the second work station 14.

First Work Station

The plates 30 and 32 are arranged in generally parallel, spaced array on opposite sides of the first work station 12 and, more particularly, on opposite sides of the horizontal support surface 27 defined by the first work station 12. The plates 30 and 32 thus define a pathway and are mounted respectively on plate support arms 48 and 50 which operate to move the plates 30, 32 to thereby vary the spacing of the plates 30, 32 one from the other by moving them toward and away from one another during the cycling operation of the apparatus. The plates 30 and 32 have an entry end 31 where the plates 30, 32 converge toward an exit end 33. The plates 30, 32 at the exit end 33 are generally parallel. The plates 30 and 32 at exit end 33 are designed to fit into the open end 36 of bag 28. The plates 30 and 32, thus, are spaced from one another and tightly retain bag 28 thereon. The bag 28 is a flexible plastic bag which is retained on a bag support rack 21 associated with the bag dispenser 20 by means of a wicket wire in a manner known to those with skill in the art.

After the product 26 is transported into the bag 28 by operation of the pusher 18, the bag 28 slides off the exit end 33 of the plates 30 and 32. The plates 30 and 32, then, move outwardly relative to one another so that the pusher blocks 44 and 46 may move along the pathway between the plates 30, 32 and thereby continue with the transport of the product 26 and bag 28 toward the second work station 14. During this transfer movement, the product 26 and flexible bag 28 are pushed through the clipper apparatus 16 and, more particularly, through the spaced gates 52 and 54 which are pivotally attached to a support plate 56 of the clipping apparatus 16. Support plate 56, thus, is supported by attachment to vertically descending and ascending frame members 58 and 60.

Second Work or Product Station

The product or second work station 14 is supported by horizontal frame members 62 and 64 which extend from the vertical frame members 58 and 60. The second work station 14 includes horizontal support members 66 and 68 which are pivotally attached to the horizontal frame members 62 and 64 respectively. Normally, the horizontal support members 66 and 68 are maintained in a horizontal position for support of the product 26 and enclosing bag 28. The support members 66 and 68 pivot about horizontal axes and thus serve as a "trap door" for support of the product 26 in the flexible bag 28. The trap door opens whenever the product 26 is finally packaged in a sealed bag 28.

A reciprocal block 34 is slidably supported on the horizontal frame members 62 and 64 in the pathway of the product 26. The block 34 moves between a retracted position, which exposes the totality of the second work station 14, to a forward position, where it engages the product 26 and flexible bag 28 as those elements are transported to the second work station 14 and through the clipping apparatus 16. Thus, the block 34 insures that the flexible bag 28 and product 26 remain tightly packed as they are transported between work stations 12 and 14.

Clipping Apparatus

The clipping station or clipping apparatus 16 is positioned intermediate the first work station 12 and the second work station 14. This permits the product 26 to be transported in a linear direction from the first work station 12 to the second work station 14 through the clipping apparatus 16. The clipping apparatus 16 is generally mounted on a support plate 56 which is suspended between the vertical frame members 58 and 60. The support plate 56 has attached thereto a first and second pivotal gates 52 and 54. The gates 52 and 54 swing about pivot axes 70 and 72 between a fully opened position and a fully closed position.

When gates 52, 54 are in the fully open position, it is possible for product 26 to fit therebetween and be moved from the first work station 12 to the second work station 14. The gates 52 and 54 are driven between the open and closed position by a pneumatic cylinder 74 which operates to drive a reciprocal bracket 76 vertically upwardly and downwardly. The bracket 76 includes outwardly projecting arms 78 and 80 which are attached respectively to links 82 and 84 that pivotally connect to the gates 52 and 54. As the bracket 76 is driven downwardly by operation of the cylinder 74, the gates 52 and 54 are driven by links 82, 84 and pivot about respective axes 70 and 72 toward one another thereby gathering bagging material therebetween and also forming a clip channel through which a U-Shaped metal clip may be driven against an anvil positioned in the bottom of one of the gates 54.

Prior to operation of the gate cylinder 74, however, a holding bar cylinder 86 also mounted on plate 56 drives a holding bar 88 vertically downward. The holding bar 88 is positioned to engage and retain the product 26 tightly within the bag and against the block 34. The holding bar also, preliminarily, causes the flexible packaging material of the flexible bag 28 to be partially folded so that when the gates 52 and 54 close they will properly form the flexible bag material for attachment of a U-Shaped metal clip. Thus, the holding bar cylinder 86 initially operates to cause the holding bar 88 to descend. Thereafter, the gate cylinder 74 operates sequentially to cause gates 52 and 54 to close.

Subsequently, a third cylinder 90 mounted on support plate 56 operates to drive a punch 91 in the clip channel formed by gate members 52, 54. The punch engages a clip fed from a clip rail 92 also mounted on plate 56. The clip is driven through the clip channel and formed about the gathered plastic material at the open end 36 of the flexible bag 28. This closes the bag 28 and the product 26 therein. A cylinder 93 then operates to engage a block 41 forward of the gates 52, 54 and the clipper to engage the film open end 36 to hold it so that the knife 95 may efficiently cut the film open end 36. Subsequent thereto, a fourth cylinder 94 mounted on one of the gates 52 is actuated to operate a knife 95 which clips off excess bag material at the outside or open end 36 of the flexible bag 28. Then the gates 52 and 54 are opened and the holding bar 88 raises. The trap doors 62, 64 are next opened to release the product 26 onto a conveyor (not shown).

Bag Dispenser

At the end of each cycle it is necessary to position a single bag 28 on the exit end 33 of plates 30 and 32. This is accomplished by operation of the bag dispenser 20. The bag dispenser 20 includes a bag support rack 21 which receives and retains a series of plastic bags 28. The open ends 36 of the bags 28 are formed so that a portion of each bag 28, at the open end 36, has a greater length. A wicket wire fits through openings in this bag extension or extra length. The wicket wire thus fits through the openings in the bag extension and into the support rack 21.

During transfer of product 26 from the first work station 12 to the second work station 14, the support rack 21 is in the recessed or retracted position. At the end of a packaging cycle, however, a cylinder 98 extends the support rack 21 upwardly and outwardly toward the second work station 14. A blast of pressurized air from a nozzle 100 supported on the frame 10 is directed into the top bag 28 on the support rack 21. This causes the bag 28 to flair open. The plates 30 and 32 are then controlled to move toward one another by the plate support arms 48 and 50 so that the plates 30 and 32 will fit into the open end 36 of the bag 28. The support rack 21 with the open bag is then transferred laterally toward the first work station 12. The support plates 30 and 32 then expand or separate from one another and tightly engage the sides of the bag 28. The support rack 21 then descends tearing the extension of the bag 28 from the wicket wire which attaches the bag to the support rack 21. A bag 28 is then in position for receipt of product 26 and the device may be cycled through its stages of operation as described.

In the foregoing description, reference is made to the packing of fowl, such as chickens or the like. However, the packaging apparatus of the invention may be utilized with respect to other materials and products. Important features of the invention include the mechanism for transferring the product from the first work station 12 to the second work station 14 through or under the clipping mechanism 16. In this regard, the clipping mechanism 16 is constructed so that there is sufficient and adequate room to transfer the product 26, including the bag for the product, from the first work station 12 to the second work station 14 without interfering with the clipping apparatus 16. Also, the mechanism for positioning the bag on the separated plates 30 and 32 may be altered or varied. Various other aspects of the invention may be modified without changing the spirit and scope of the invention. The invention is therefore to be limited only by the following claims and their equivalents.

What is claimed is:

1. Legged fowl packaging apparatus for packaging of fowl having legs, said apparatus comprising, in combination:

a frame having a horizontal support surface for supporting a legged fowl at a first station, the support surface including an elongated slot;

guide plates on each side of the support surface, said guide plates having an entry end defined by converging plates and an exit end, said exit end including spaced plates adapted to receive and hold open an end of a flexible bag positioned in the pathway of discharge of the fowl from the exit end;

a reciprocal pusher mounted on the frame at the entry end of the guide plates, said pusher including a driving arm fitted through the slot in the support surface and extending both above and below the support surface, the pusher further including a block member connected to the driving arm above the support surface, the block member positioned above the support surface for engaging the legs of the fowl and positioning the legs for packaging the fowl, the pusher further including means beneath the support surface connected to the driving arm below the support surface for moving the driving arm along the slot and thereby moving the driving arm and the block member between a retracted position to enable placement of fowl on the support surface and an extended position wherein fowl placed on the support surface is transferred between the plates into a flexible bag held open by the plates, and the bag and fowl are further transported in a continued linear direction to a second, separate station on the frame for closure of the bag;

the block member of the reciprocal pusher including a first, upper block and a second, lower block, the upper block being driven directly by the driving arm, the lower block being slidably attached to the upper block and being spring biased relative to the upper block to bias the lower block forwardly of the upper block toward the second station on the frame, the lower block including indentations for engaging the leg of a fowl located breast-side down on the support surface thereby forcing those legs upwardly and thereby positioning the legs for packaging the fowl, said pusher movable between the retracted position, too enable placement of fowl on the support surface, and the extended position, wherein fowl placed on the support surface is engaged by, first, the lower block and then the upper block, the blocks thereby pushing the fowl between the plates into a flexible bag held open by the plates, and the bag and fowl further being transported by the blocks in a continued linear direction to the second, separate station on the frame for closure of the bag;

a clip attachment assembly mounted on the frame intermediate the exit end of the guide plates and the second station whereby the open end of the bag, upon transfer of the fowl to the second station, is intermediate the first station and the second station and thus freely engageable by the clip attachment mechanism, said clip attachment assembly including: a mounting plate with a clip channel, first and second gate members, said gate members pivotally mounted on the mounting plate for movement between a bag gathering and a bag release position, said gate members defining a clip channel extension for guiding and forming U-shaped metal clips about material gathered between the gates when the gate members are in the bag gathering position, a punch reciprocal in the clip channel and channel extension for driving a clip about gathered material, and drive means for driving the gates between the bag gathering and bag release position and for driving the punch; and a movable blocking member in the pathway of the fowl and bag for engaging therewith during movement toward the second station.

2. The apparatus of claim 1 including a horizontal bar mechanism on the frame positioned adjacent the clip attachment apparatus and over the second station; and a drive mechanism for moving the horizontal bar mechanism vertically downward to engage and hold the packaged product at the second station during operation of the clip attachment apparatus.

3. Legged fowl packaging apparatus as in claim 1, further comprising a bag dispenser mounted on the frame including a bag support rack which receives and retains a series of bags, including a top bag, the bag support rack movable between a retracted position and a position toward the second station, means mounted on the frame for directing pressurized air into the top bag when the bag support rack is in the position toward the second station, causing the top bag to flare open, the bag support rack being further movable from the position toward the second station to a position toward the first station, causing the guide plates to fit into the open top bag when the bag support rack is in the position toward the first station, the bag support rack further movable from the position toward the first station to the retracted position, the top bag separating from the series of bags when the bag support rack moves to the retracted position, the top bag remaining on the guide plates for receipt of a fowl and a next bag becoming the new top bag on the bag support rack, and the bag support rack being simultaneously retracted from interference with the pusher.

4. Legged fowl packaging apparatus for packaging of fowl having legs, said apparatus comprising, in combination:

a frame having a horizontal support surface for supporting a legged fowl at a first station, the support surface including an elongated slot;

guide plates on each side of the support surface, said guide plates having an entry end defined by converging plates and an exit end, said exit end including spaced plates adapted to receive and hold open an end of a flexible bag positioned in the pathway of discharge of the fowl from the exit end;

a reciprocal pusher mounted on the frame at the entry end of the guide plates, said pusher including a driving arm fitted through the slot in the support surface and extending both above and below the support surface, the pusher further including a block member connected to the driving arm above the support surface, the block member positioned above the support surface for engaging the legs of the fowl and positioning the legs for packaging the fowl, the pusher further including means beneath the support surface connected to the driving arm below the support surface for moving the driving arm along the slot and thereby moving the driving arm and the block member between a retracted position to enable placement of fowl on the support surface and an extended position wherein fowl placed on the support surface is transferred between the plates into a flexible bag held open by the plates, and the bag and fowl are further transported in a continued linear direction to a second, separate station on the frame for closure of the bag;

a clip attachment assembly mounted on the frame intermediate the exit end of the guide plates and the second station whereby the open end of the bag, upon transfer of the fowl to the second station, is intermediate the first station and the second station and thus freely engageable by the clip attachment mechanism, said clip attachment assembly including: a mounting plate with a clip channel, first and second gate members, said gate members pivotally mounted on the mounting plate for movement between a bag gathering and a bag release position, said gate members defining a clip channel extension for guiding and forming U-shaped metal clips about material gathered between the gates when the gate members are in the bag gathering position, a punch reciprocal in the clip channel and channel extension for driving a clip about gathered material, and drive means for driving the gates between the bag gathering and bag release position and for driving the punch;

a movable blocking member in the pathway of the fowl and bag for engaging therewith during movement toward the second station; and and a bag dispenser mounted on the frame including a bag support rack which receives and retains a series of bags, including a top bag, the bag support rack movable between a retracted position and a position toward the second station, means mounted on the frame for directing pressurized air into the top bag when the bag support rack is in the position toward the second station, causing the top bag to flare open, the bag support rack being further movable from the position toward the second station to a position toward the first station, causing the guide plates to fit into the open top bag when the bag support rack is in the position toward the first station, the bag support rack further movable from the position toward the first station to the retracted position, the top bag separating from the series of bags when the bag support rack moves to the retracted position, the top bag remaining on the guide plates for receipt of a fowl and a next bag becoming the new top bag on the bag support rack, and the bag support rack being simultaneously retracted from interference with the pusher.

5. Legged fowl packaging apparatus for packaging of fowl having legs, said apparatus comprising, in combination:

a frame having a horizontal support surface for supporting a legged fowl at a first station, the support surface including an elongated slot;

guide plates on each side of the support surface, said guide plates having an entry end defined by converging plates and an exit end, said exit end including spaced plates adapted to receive and hold open an end of a flexible bag positioned in the pathway of discharge of the fowl from the exit end;

a reciprocal pusher mounted on the frame at the entry end of the guide plates, said pusher including a driving arm fitted through the slot in the support surface and extending both above and below the support surface, the pusher further including a block member connected to the driving arm above the support surface, the block member positioned above the support surface for engaging the legs of the fowl and positioning the legs for packaging the fowl, the pusher further including means beneath the support surface connected to the driving arm below the support surface for moving the driving arm along the slot and thereby moving the driving arm and the block member between a retracted position to enable placement of fowl on the support surface and an extended position wherein fowl placed on the support surface is transferred between the plates into a flexible bag held open by the plates, and the bag and fowl are further transported in a continued linear direction to a second, separate station on the frame for closure of the bag;

the block member of the reciprocal pusher including a first, upper block and a second, lower block, the upper block being driven directly by the driving arm, the lower block being slidably attached to the upper block and being spring biased relative to the upper block to bias the lower block forwardly of the upper block toward the second station on the frame, the lower block including indentations for engaging the legs of a fowl located breast-side down on the support surface thereby forcing those legs upwardly and thereby positioning the legs for packaging the fowl, said pusher movable between the retracted position, to enable placement of fowl on the support surface, and the extended position, wherein fowl placed on the support surface is engaged by, first, the lower block and then the upper block, the blocks thereby pushing the fowl between the plates into a flexible bag held open by the plates, and the bag and fowl further being transported by the blocks in a continued linear direction to the second, separate station on the frame for closure of the bag;

a clip attachment assembly mounted on the frame intermediate the exit end of the guide plates and the second station whereby the open end of the bag, upon transfer of the fowl to the second station, is intermediate the first station and the second station and thus freely engageable by the clip attachment mechanism; and a movable blocking member in the pathway of the fowl and bag for engaging therewith during movement toward the second station.

6. Legged fowl packaging apparatus for packaging of fowl having legs, said apparatus comprising, in combination:

a frame having a horizontal support surface for supporting a legged fowl at a first station, the support surface defining an elongated slot;

guide plates on each side of the support surface, said guide plates having an entry end defined by converging plates and an exit end, said exit end including spaced plates adapted to receive and hold open an end of a flexible bag positioned in the pathway of discharge of the fowl from the exit end;

a reciprocal pusher mounted on the frame at the entry end of the guide plates, said pusher including a driving arm fitted through the slot in the support surface and extending both above and below the support surface, the pusher further including a block member connected to the driving arm above the support surface, the block member positioned above the support surface for engaging the legs of the fowl and positioning the legs for packaging the fowl, the pusher further including means beneath the support surface connected to the driving arm below the support surface for moving the driving arm along the slot and thereby moving the driving arm and the block member between a retracted position to enable placement of fowl on the support surface and an extended position wherein fowl placed on the support surface is transferred between the plates into a flexible bag held open by the plates, and the bag and fowl are further transported in a continued linear direction to a second, separate station on the frame for closure of the bag;

a clip attachment assembly mounted on the frame intermediate the exit end of the guide plates and the second station whereby the open end of the bag, upon transfer of the fowl to the second station, is intermediate the first station and the second station and thus freely engageable by the clip attachment mechanism;

a movable blocking member in the pathway of the fowl and bag for engaging therewith during movement toward the second station; and and a bag dispenser mounted on the frame including a bag support rack which receives and retains a series of bags, including a top bag, the bag support rack movable between a retracted position and a position toward the second station, means mounted on the frame for directing pressurized air into the top bag when the bag support rack is in the position toward the second station, causing the top bag to flare open, the bag support rack being further movable from the position toward the second station to a position toward the first station, causing the guide plates to fit into the open top bag when the bag support rack is in the position toward the first station, the bag support rack further movable from the position toward the first station to the retracted position, the top bag separating from the series of bags when the bag support rack moves to the retracted position, the top bag remaining on the guide plates for receipt of a fowl and a next bag becoming the new top bag on the bag support rack, and the bag support rack being simultaneously retracted from interference with the pusher.

* * * * *